US007604039B2

(12) United States Patent
Nikolovski et al.

(10) Patent No.: US 7,604,039 B2
(45) **Date of Patent: *Oct. 20, 2009**

(54) CASTING STEEL STRIP

(75) Inventors: Nikolco S. Nikolovski, Figtree (AU); Rama Ballav Mahapatra, Brighton-Le-Sands (AU); Lazar Strezov, Adamstown Heights (AU)

(73) Assignee: Castrip, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/456,633

(22) Filed: Jul. 11, 2006

(65) Prior Publication Data

US 2006/0243417 A1 Nov. 2, 2006

Related U.S. Application Data

(60) Division of application No. 10/077,391, filed on Feb. 15, 2002, now Pat. No. 7,073,565, which is a continuation-in-part of application No. 09/495,754, filed on Feb. 1, 2000, now abandoned.

(30) Foreign Application Priority Data

Feb. 5, 1999 (AU) ..... PP8525

(51) Int. Cl.
*B22D 11/06* (2006.01)

(52) U.S. Cl. ..... 164/428

(58) Field of Classification Search ..... 164/428, 164/442, 480, 448

See application file for complete search history.

(56) References Cited

U.S. PATENT DOCUMENTS 4,250,950 A 2/1981 Buxmann et al.
4,368,084 A 1/1983 Irie et al.
4,588,021 A * 5/1986 Bergeron et al. ..... 164/432
4,865,117 A 9/1989 Bartlett et al.
4,887,662 A 12/1989 Tanaka et al.
5,227,251 A 7/1993 Suichi et al.
5,520,243 A 5/1996 Freeman et al.
5,588,479 A 12/1996 Leadbetter et al.
5,701,948 A * 12/1997 Strezov et al. ..... 164/480
5,720,336 A 2/1998 Strezov (Continued)

FOREIGN PATENT DOCUMENTS

EP 0471608 2/1992

(Continued)

*Primary Examiner*—Kevin P Kerns
(74) *Attorney, Agent, or Firm*—Hahn Loeser & Parks; Arland T. Stein

(57) ABSTRACT

In twin roll casting of steel strip, molten steel is introduced into the nip between parallel casting rolls to create a casting pool supported on casting surfaces of the rolls and the rolls are rotated to deliver solidified strip downwardly from the nip. Casting surfaces are textured by a random pattern of discrete projections, which may have an average surface distribution of between 5 and 200 peaks per $mm^2$ and an average height of at least 10 microns. In order to suppress chatter defects, the molten steel also has manganese content of at least 0.55% by weight and a silicon content in the range of 0.1 to 0.35% by weight. The strip is thus capable of moving away from the casting pool at a speed of more than 60 meters per minute without substantial high speed chattering defects.

15 Claims, 8 Drawing Sheets

U.S. PATENT DOCUMENTS

| | | | | |
|---|---|---|---|---|
| 5,807,444 | A | 9/1998 | Paradis et al. | |
| 6,059,014 | A | 5/2000 | Strezov | |
| 6,120,621 | A | 9/2000 | Jin et al. | |
| 6,679,313 | B2 * | 1/2004 | Poirier et al. | 164/428 |
| 6,896,033 | B2 | 5/2005 | Yamamura et al. | |
| 6,942,013 | B2 * | 9/2005 | Strezov et al. | 164/480 |

FOREIGN PATENT DOCUMENTS

| | | | |
|---|---|---|---|
| EP | 0572681 | | 12/1993 |
| EP | 0796685 | | 9/1997 |
| EP | 0800881 | | 10/1997 |
| EP | 1029617 | | 1/2004 |
| EP | 0706845 | | 7/2006 |
| FR | 1364717 | | 5/1964 |
| JP | 60040650 | | 8/1983 |
| JP | 03128149 | | 5/1991 |
| JP | 04041052 | | 2/1992 |
| JP | 6-134553 A | * | 5/1994 |
| JP | 06-134553 A | | 5/1994 |
| JP | 06134553 | | 5/1994 |
| JP | 08-165523 | | 6/1996 |
| JP | 08294751 | | 11/1996 |
| JP | 09-001209 | | 1/1997 |
| WO | 94/12300 | | 6/1994 |
| WO | 95/13889 | | 5/1995 |
| WO | 00/07753 | | 2/2000 |

* cited by examiner

CASTING STEEL STRIP

RELATED APPLICATION

This application is a divisional application of application Ser. No. 10/077,391 filed Feb. 15, 2002, now U.S. Pat. No. 7,073,565 which is a continuation-in-part of application Ser. No. 09/495,754, filed Feb. 1, 2000, now abandoned, the disclosures of which are hereby incorporated by reference.

TECHNICAL FIELD

This invention relates to the casting of steel strip.

It is known to cast metal strip by continuous casting in a twin roll caster. In this technique molten metal is introduced between a pair of contra-rotated horizontal casting rolls that are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of vessels from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

Although twin roll casting has been applied with some success to non-ferrous metals that solidify rapidly on cooling, there have been problems in applying the technique to the casting of ferrous metals. One particular problem has been the achievement of sufficiently rapid and even cooling of metal over the casting surfaces of the rolls. In particular it has proved difficult to obtain sufficiently high cooling rates for solidification onto casting rolls with smooth casting surfaces and it has therefore been proposed to use rolls having casting surfaces which are deliberately textured by regular patterns of projections and depressions to control heat transfer and so control the heat flux achieved at the casting surfaces during solidification.

Our U.S. Pat. No. 5,701,948 discloses a casting roll texture formed by a series of parallel groove and ridge formations. More specifically, in a twin roll caster the casting surfaces of the casting rolls may be textured by the provision of circumferentially extending groove and ridge formations of essentially constant depth and pitch. This texture produces enhanced heat flux during metal solidification and can be optimized for casting of steel in order to achieve both high heat flux values and a fine microstructure in the as cast steel strip. Essentially when casting steel strip, the depth of the texture from ridge peak to groove root should be in the range 5 microns to 60 microns and the pitch of the texture should be in the range 100 to 250 microns for best results. For optimum results it is preferred that the depth of the texture be in the range 15 to 25 microns and that the pitch be between 150 and 200 microns.

Although rolls with the texture disclosed in U.S. Pat. No. 5,701,948 have enabled achievement of high solidification rates in the casting of ferrous metal strip, it has been found that they exhibit a marked sensitivity to the casting conditions which must be closely controlled to avoid two general kinds of strip defects known as "crocodile-skin" and "chatter" defects. More specifically, it has been necessary to control crocodile-skin defects by the controlled addition of sulphur to the melt and to avoid chatter defects by operating the caster within a narrow range of casting speeds.

The crocodile-skin defect occurs when δ and γ iron phases solidify simultaneously in shells on the casting surfaces of the rolls in a twin roll caster under circumstances in which there are variations in heat flux through the solidifying shells. The δ and γ iron phases have differing hot strength characteristics and the heat flux variations then produce localized distortions in the solidifying shells that come together at the nip between the casting rolls and result in the crocodile-skin defects in the surfaces of the resulting strip.

A light oxide deposit on the rolls having a melting temperature below that of the metal being cast can be beneficial in ensuring a controlled even heat flux during metal solidification on to the casting roll surfaces. The oxide deposit melts as the roll surfaces enter the molten metal casting pool and assists in establishing a thin liquid interface layer between the casting surface and the molten metal of the casting pool to promote good heat flux. However, if there is too much oxide build-up, the melting of the oxides produces a very high initial heat flux but the oxides then re-solidify with the result that the heat flux decreases rapidly. This problem has been addressed by endeavoring to keep the build-up of oxides on the casting rolls within strict limits by roll cleaning devices. However, where roll cleaning is non-uniform, there are variations in the amount of oxide build-up with the resulting heat flux variations in the solidifying shells producing localized distortions leading to crocodile-skin defects.

Chatter defects are initiated at the meniscus level of the casting pool where initial metal solidification occurs. One form of chatter defect, called "low speed chatter", is produced at low casting speeds due to premature freezing of the metal high up on the casting rolls so as to produce a weak shell that subsequently deforms as it is drawn further into the casting pool. The other form of chatter defect, called "high speed chatter", occurs at higher casting speeds when the shell starts forming further down the casting roll so that there is liquid above the forming shell. This liquid that feeds the meniscus region cannot keep up with the moving roll surface, resulting in slippage between the liquid and the roll in the upper part of the casting pool, thus giving rise to high speed chatter defects appearing as transverse deformation bands across the strip.

Moreover, to avoid low speed chatter on the one hand and high speed chatter on the other, it has been necessary to operate within a very narrow window of casting speeds. Typically it has been necessary to operate at a casting speed within a narrow range of 30 to 36 meters per minute. The specific speed range can vary from roll to roll but in general the casting speed must be well below 40 meters per minute to avoid high speed chatter.

The present invention enables significant suppression of the tendency for chatter defects by selection of the chemistry of the steel melt in association with a randomly textured casting surface. The invention enables the range of possible casting speeds to be greatly expanded. In particular, it enables significantly higher casting speeds to be achieved. At casting speeds above 60 meters/minute a new type of chatter defect, termed "high frequency" chatter is encountered but this can be alleviated by use of random patterned textured casting surface on the casting rolls and selection of the melt chemistry in accordance with the present invention.

DISCLOSURE OF THE INVENTION

According to the invention there is provided a method of continuously casting steel strip comprising supporting a casting pool of molten steel on one or more chilled casting surfaces and moving the chilled casting surface or surfaces to produce a solidified strip moving away from the casting pool, wherein each casting surface is textured by a random pattern of discrete projections and the molten steel has a manganese content of at least 0.55% by weight and a silicon content in the range of 0.1 to 0.35% by weight.

The method permits the casting of steel strip at casting speeds of more than 60 meters per minute while substantially avoiding high-speed chatter. The strip may be moved away from the casting pool at a speed of at least 75 meters per minute. More specifically, it may be moved away from the casting pool at a speed in the range of 75 to 150 meters per minute.

The random pattern of discrete projections is such as are produced by grit blasting the casting surface as hereinafter described. The discrete projections may have pointed peaks, but generally because of the nature of their formation, such discrete projections do not have such pointed peaks. It has been found that the peaks of the discrete projections have flat areas of typically 100 to 400 square microns due to the nature of formation, e.g., grit blasting. The discrete projections have peaks that have an average surface distribution of between 5 and 200 peaks per $mm^2$, with average peak distributions above 100 peaks per $mm^2$ used with higher casting speeds. The average height of the discrete projections may be at least 10 microns and more preferably at least 20 microns.

The manganese content of the steel may be in the range 0.55 to 0.9% by weight. The steel may have a carbon content of less than 0.07% by weight.

The method of the present invention may be carried out in a twin roll caster. Accordingly the invention further provides a method of continuously casting steel strip of the kind in which molten metal is introduced into the nip between a pair of parallel casting rolls via a metal delivery nozzle disposed above the nip to create a casting pool of molten steel supported on casting surfaces of the rolls immediately above the nip and the casting rolls are rotated to deliver a solidified steel strip downwardly from the nip, wherein the casting surfaces of the rolls are each textured by a random pattern of discrete projections, and the molten steel has a manganese content of at least 0.55% by weight and a silicon content in the range of 0.1 to 0.35% by weight. As a result, the strip may be moved away from the casting pool at a speed of more than 60 meters per minute without substantial high-speed chatter encountered.

The texture of the casting surface or surfaces can be achieved by grit blasting each casting surface or a metal substrate that is protected by a surface coating to produce the casting surface. For example the texture on each casting surface may be produced by grit blasting a copper substrate that is subsequently plated with a thin protective layer of chrome. Alternatively the casting surface may be formed of nickel in which case the nickel surface may be grit blasted and no other protective coating applied.

The required texture on each casting surface may alternatively be obtained by deposition of a coating onto a substrate. In this case, the material of the coating may be chosen to control the heat flux during metal solidification. Said material may be a material that has a low affinity for the steel oxidation products so that wetting of the casting surfaces by those deposits is poor. More particularly the casting surface may be formed of an alloy of nickel, chromium and molybdenum or alternatively an alloy of nickel, molybdenum and cobalt, the alloy being deposited so as to produce the required texture.

BRIEF DESCRIPTION OF THE DRAWINGS

In order that the invention may be more fully explained, results of trials carried out to date will be described with reference to the accompanying drawings in which.

DETAILED DESCRIPTION OF THE DRAWINGS

Figure 1:
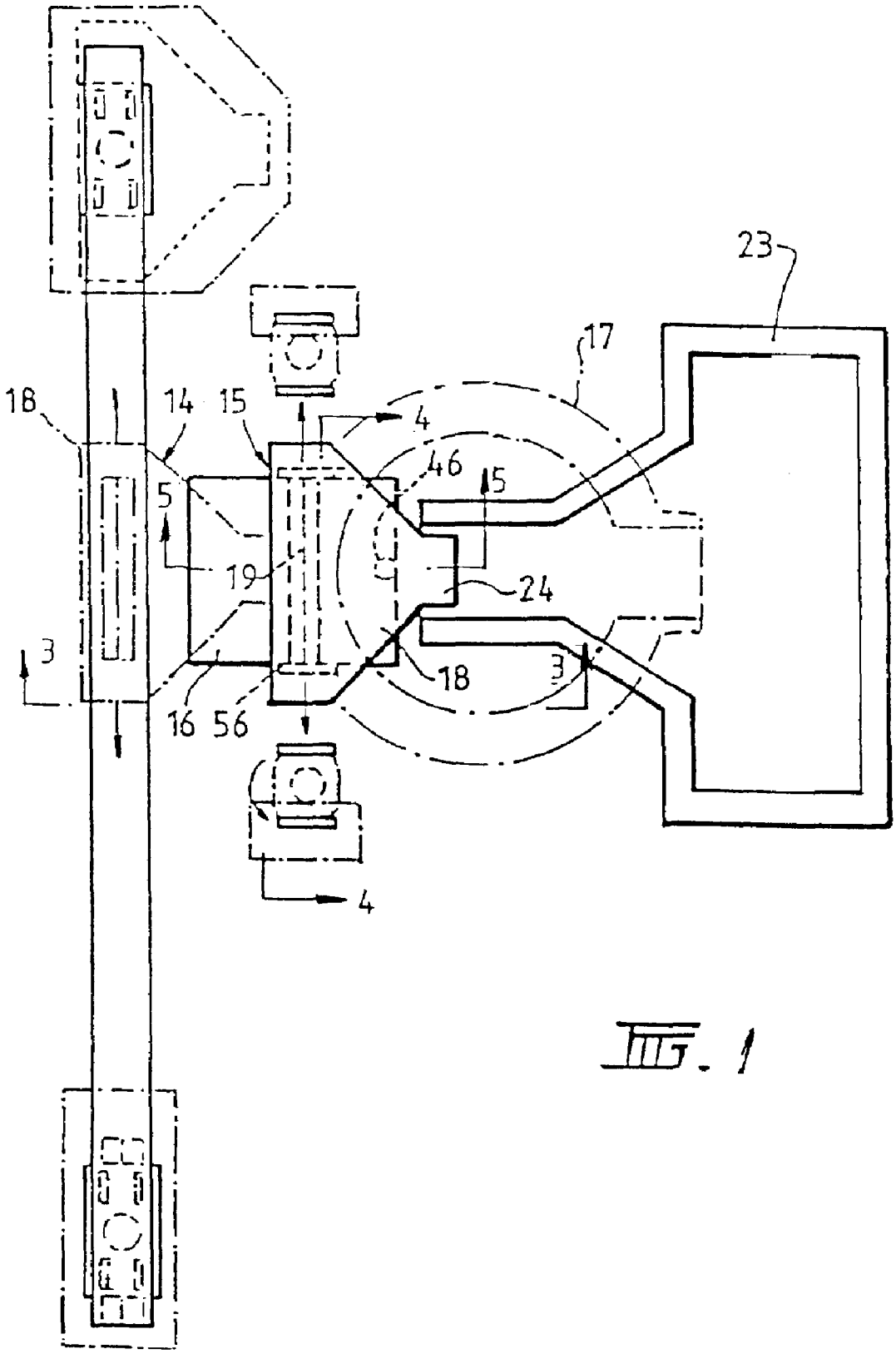
FIG. 1 is a plan view of a continuous strip caster which is operate in accordance with the invention.
Figure 2:
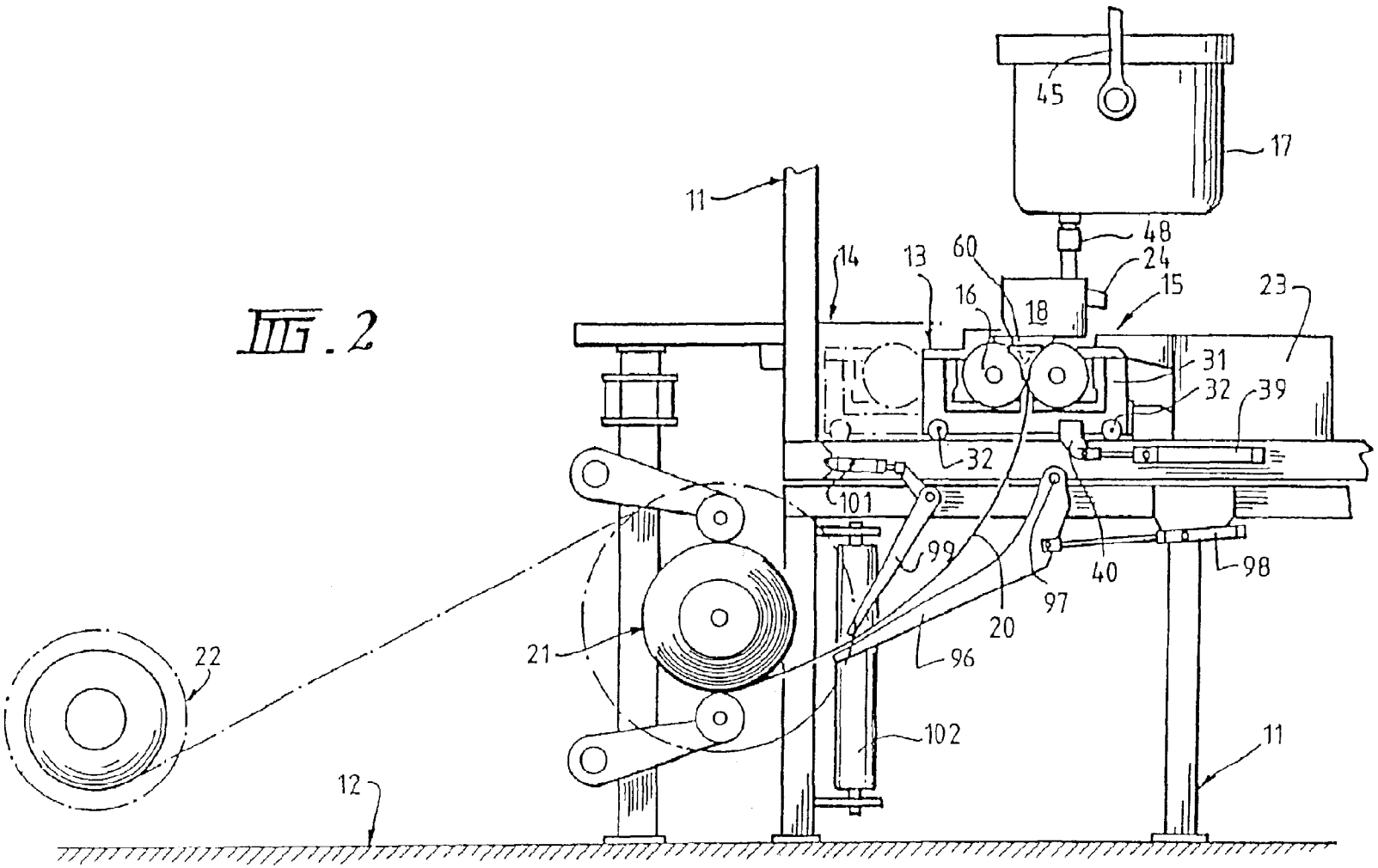
FIG. 2 is a side elevation of the strip caster show in FIG. 1.
Figure 3:
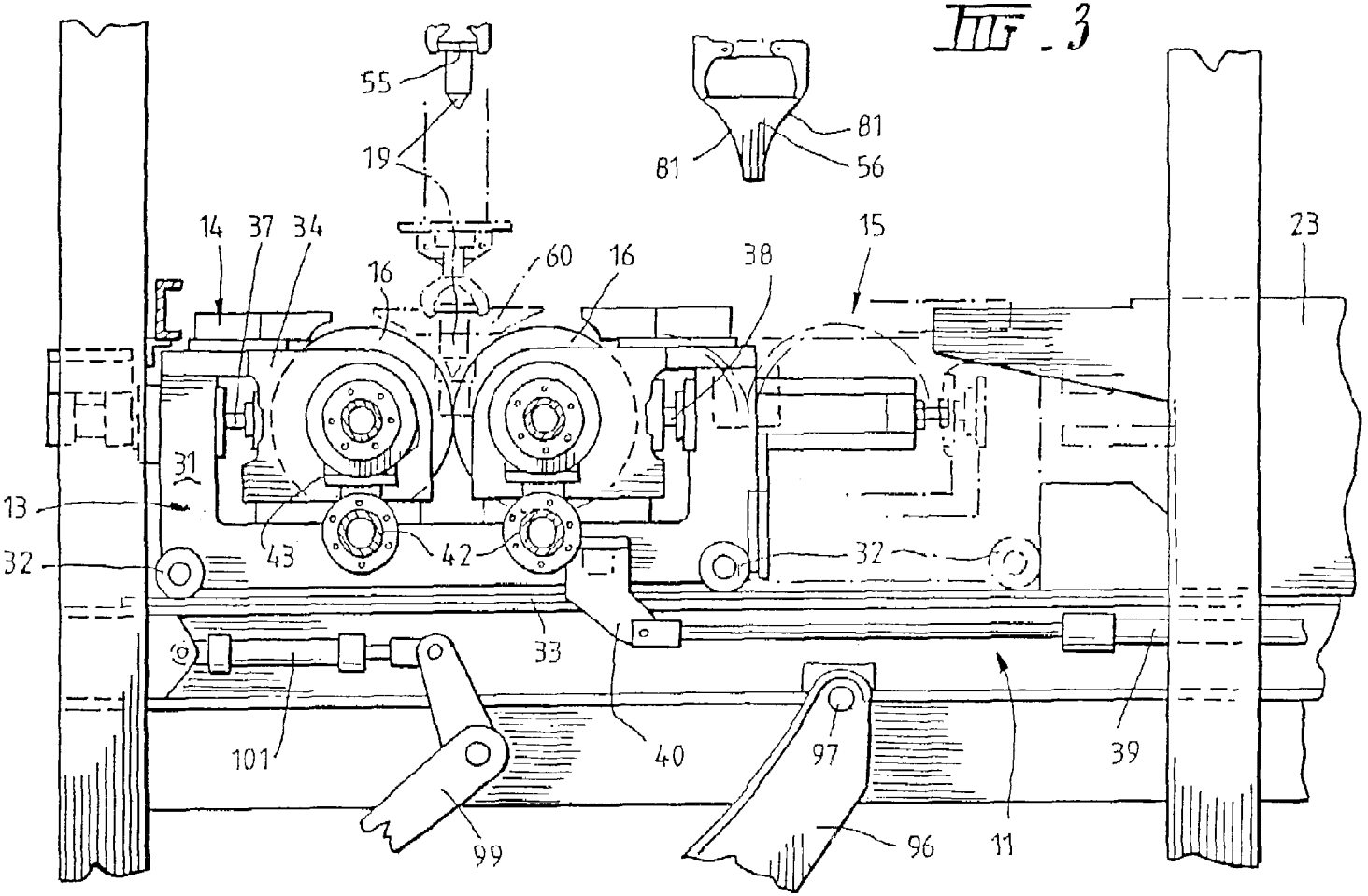
FIG. 3 is a vertical cross-section on the line 3-3 in FIG. 1.
Figure 4:
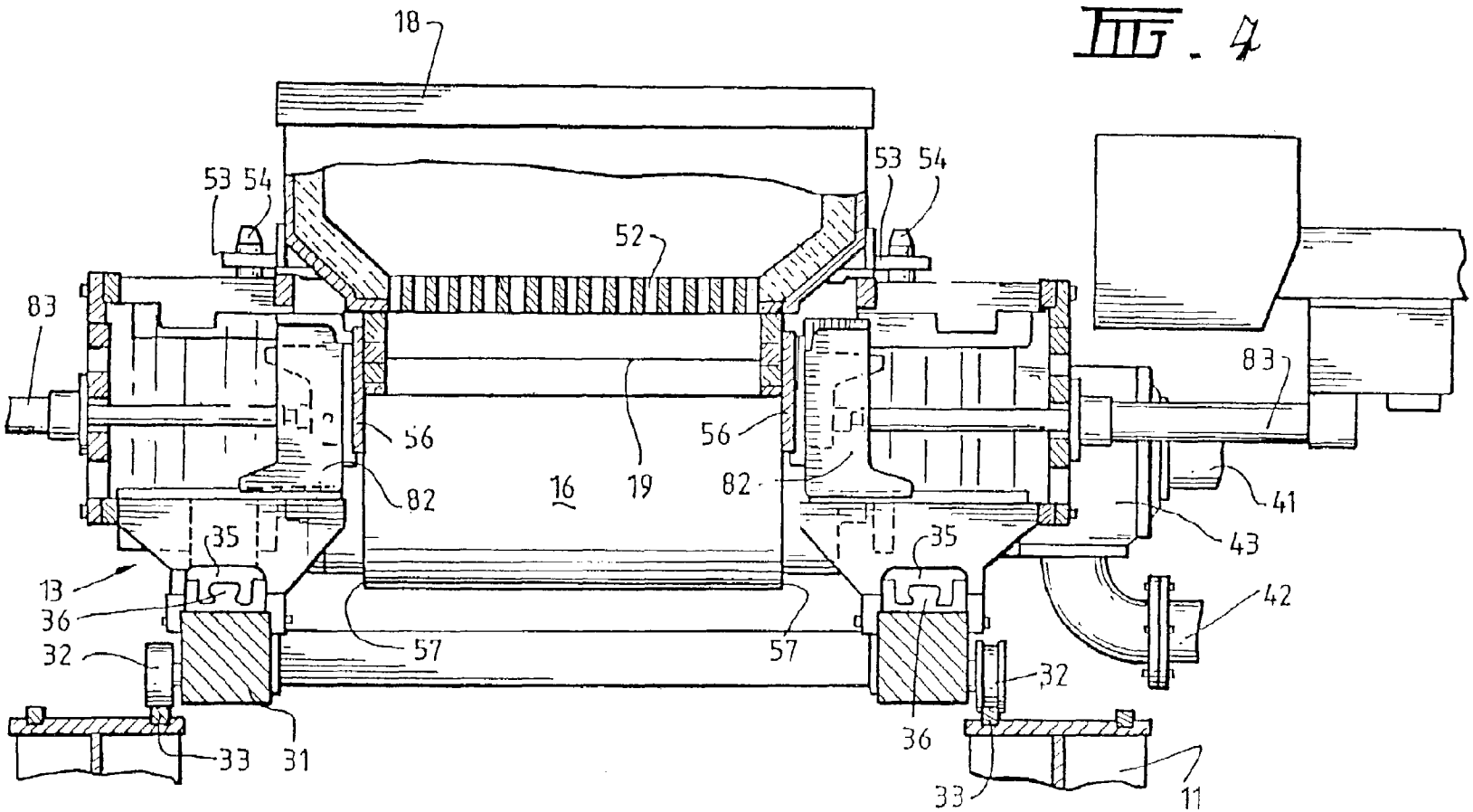
FIG. 4 is a vertical cross-section on the line 4-4 in FIG. 1.
Figure 5:
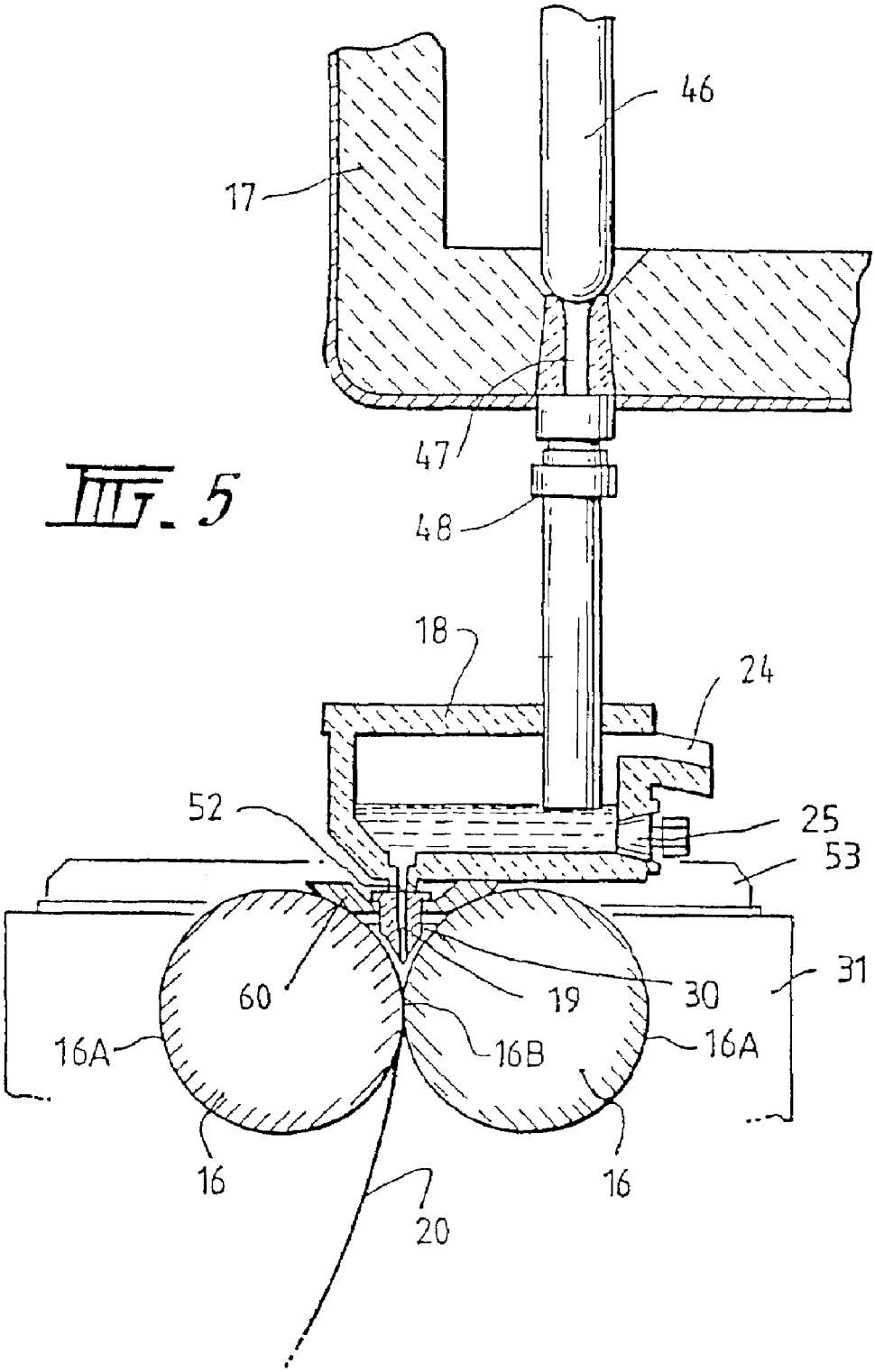
FIG. 5 is a vertical cross section on the line 5-5 in FIG. 1.

U.S. Pat. No. 5,701,948 describes how steel strip can be cast in a twin roll caster in which the casting rolls are provided with a regular texture of parallel groove and ridge formations. The present invention may employ a twin roll caster of the same kind as disclosed in that U.S. patent, but in which the casting rolls have randomly textured surfaces formed by grit blasting. A preferred form of apparatus is illustrated in FIGS. 1 to 5 of the accompanying drawings.

The caster illustrated in FIGS. 1 to 5 comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a distributor 18 and delivery nozzle 19 to create a casting pool 30. Casting rolls 16 are water cooled so that shells solidify on the moving roll surfaces 16A and are brought together at the nip 16B between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor or by withdrawal of an emergency plug 25 at one side of the distributor if there is a severe malformation of product or other severe malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by interengaging complementary slide members 35, 36 to allow the cradles to be moved on the carriage under the influence of hydraulic cylinder units 37, 38 to adjust the nip between the casting rolls 16 and to enable the rolls to be rapidly moved apart for a short time interval when it is required to form a transverse line of weakness across the strip as will be explained in more detail below. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted (not shown) on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce 2000 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor 18.

Distributor 18 is formed as a wide dish made of a refractory material such as magnesium oxide (MgO). One side of the distributor receives molten metal from the ladle and is provided with the aforesaid overflow 24 and emergency plug 25. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as to accurately locate the distributor.

Delivery nozzle 19 is formed as an elongate body made of a refractory material such as alumina graphite. Its lower part is tapered so as to converge inwardly and downwardly so that it can project into the nip between casting rolls 16. It is provided with a mounting bracket 60 whereby to support it on the roll carriage frame and its upper part is formed with outwardly projecting side flanges 55 which are located on the mounting bracket.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of slide closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to pour from the ladle to the distributor through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of a hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

Full particulars of a twin roll caster of the kind illustrated in FIGS. 1 to 5 are more fully described in our International Patent application WO/94/12300.

It has been found that a roll casting surface produced with a random pattern of discrete projections as produced by grit or shot blasting is much less prone to generation of chatter defects at casting speeds above 60 meters/minute, although at higher casting speeds, high frequency chatter is encountered where steel chemistry is not controlled as described herein. It has been determined that the randomness of the texture is very important to achieving a microstructure which is homogenous and resistant to crack propagation. The discrete projections of this random texture so formed may have pointed peaks, but because of the nature of formation (e.g., by grit blasting) will typically have flat areas at the peaks of 100 to 400 square microns.

An appropriate random pattern texture with such discrete projections can be imparted to a metal substrate by grit blasting with hard particulate materials such as alumina, silica, or silicon carbide having a particle size of the order of 0.7 to 1.4 mm. For example, a copper roll surface may be grit blasted in this way to impose an appropriate texture and the textured surface protected with a thin chrome coating of the order of 50 microns thickness.

Figure 6:
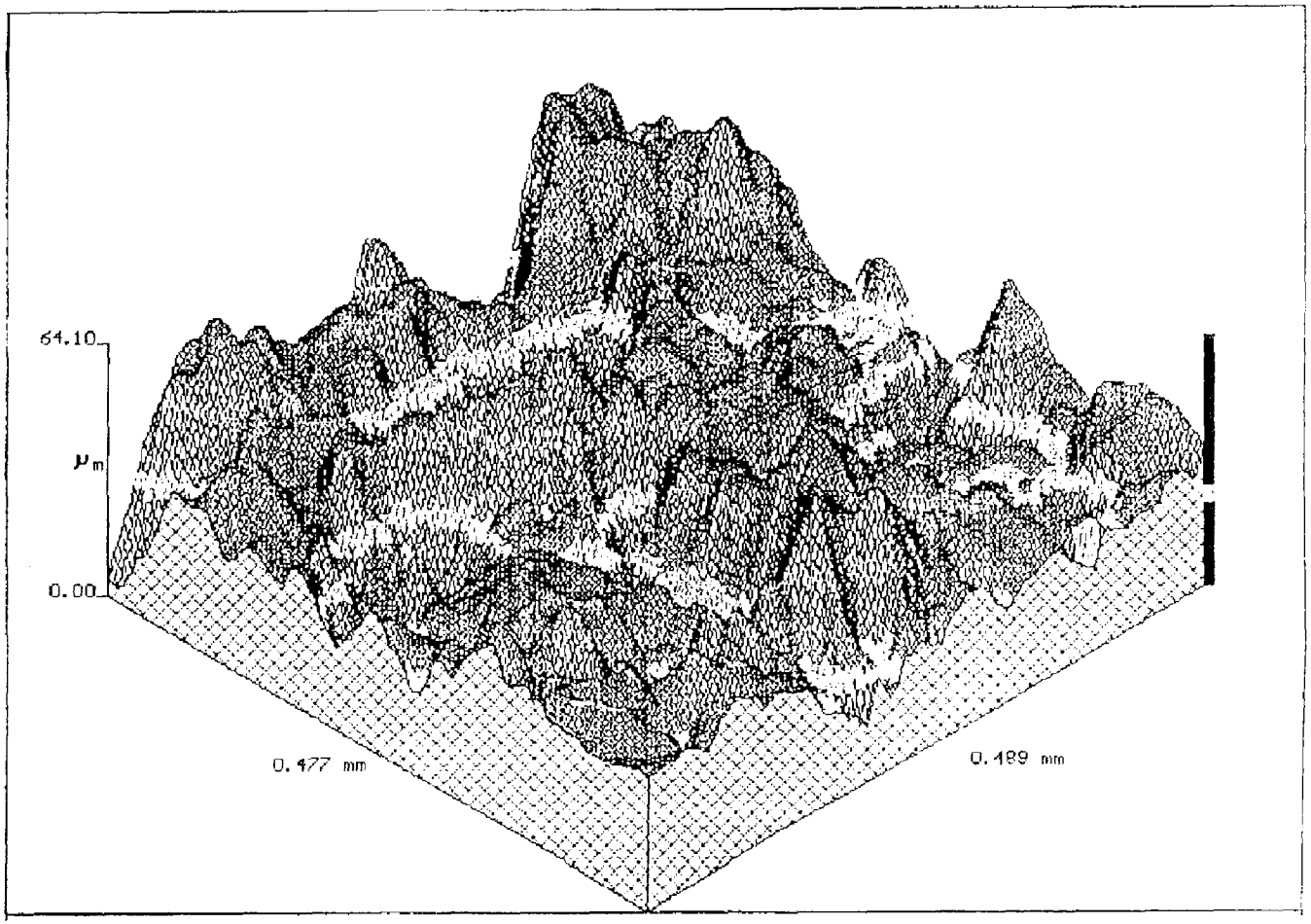
FIG. 6 represents a typical casting surface texture used in the method of the present invention.

FIG. 6 illustrates a typical casting surface with random pattern of discrete projections produced in this manner. Typically, the average peak-to-peak spacing between discrete projections is between 130 and 200 microns, so that the average peak distribution of the discrete projections is between 40 and 70 peaks per $mm^2$. The peak spacing was measured using a Surtronics 3+ Taylor Hobson Roughness measuring device, which measures surface roughness (Ra) and the average spacing between discrete projections (Sm) where Sm is measured in millimeters (mms) or microns. The average number of peaks per unit area can then be determined, e.g., number of peaks in 1 $mm^2=[(1/Sm)+1]^2$ where Sm is given in mms. Alternatively it would be possible to apply a textured surface with such random pattern of discrete projections directly to a nickel substrate with no additional protective coating.

It is also possible to achieve an appropriate random pattern texture with such discrete projections by forming a coating by chemical deposition or electrodeposition. In this case the coating material may be chosen so as to contribute to high thermal conductivity and increased heat flux during solidification. It may also be chosen such that the oxidation products in the steel exhibit poor wettability on the coating material, with the steel melt itself having a greater affinity for the coating material and therefore wetting the coating in preference to the oxides. We have determined that two suitable materials are the alloy of nickel, chromium and molybdenum available commercially under the trade name "HASTALLOY C" and the alloy of nickel, molybdenum and cobalt available commercially under the trade name "T800". Our International Patent Application WO/00/07753 describes the results of tests using randomly-patterned textured casting surfaces formed by coatings of HASTALLOY C and T800 showing that the solidified shells deposited on such surfaces are of remarkably even microstructure and of uniform thickness.

Casting trials have been carried out on a twin roll caster fitted with grit blasted random patterned textured casting rolls using low carbon steel having a range of manganese and silicon contents designed to test two hypotheses as to the cause of the high frequency chatter defects encountered as the casting speed is increased.

It has been found that in addition to the patterned textured casting rolls, the chemistry of the steel needs to be controlled to avoid high frequency chatter. One hypothesis for high frequency chatter is that it is due to lack of wetting of the casting surfaces as the casting speed increases. On this hypothesis, the problem should be alleviated by controlling the steel chemistry so that oxidation products produce low temperature liquidus inclusions promoting wettability. This can be achieved by controlling the manganese and silicon contents of the steel. However, it has been found that control of steel chemistry alone is not sufficient to avoid high frequency chatter.

A second hypothesis for the generation of high frequency chatter defects is that it is generated by the lack of cushioning effect of the mushy zone where the solidifying shells come together to form the strip. This hypothesis has been tested by varying the carbon content of the steel for the same manganese content so as to produce a thicker mushy zone. The results of these tests show that the effects of both hypotheses work together to contribute the high frequency chatter defects. The trials have shown that in order to eliminate high frequency chatter defects at high casting speeds, it is necessary to control the manganese content and the silicon content of the steel, as well as provide a random-patterned textured surface on the casting rolls.

Figure 7:
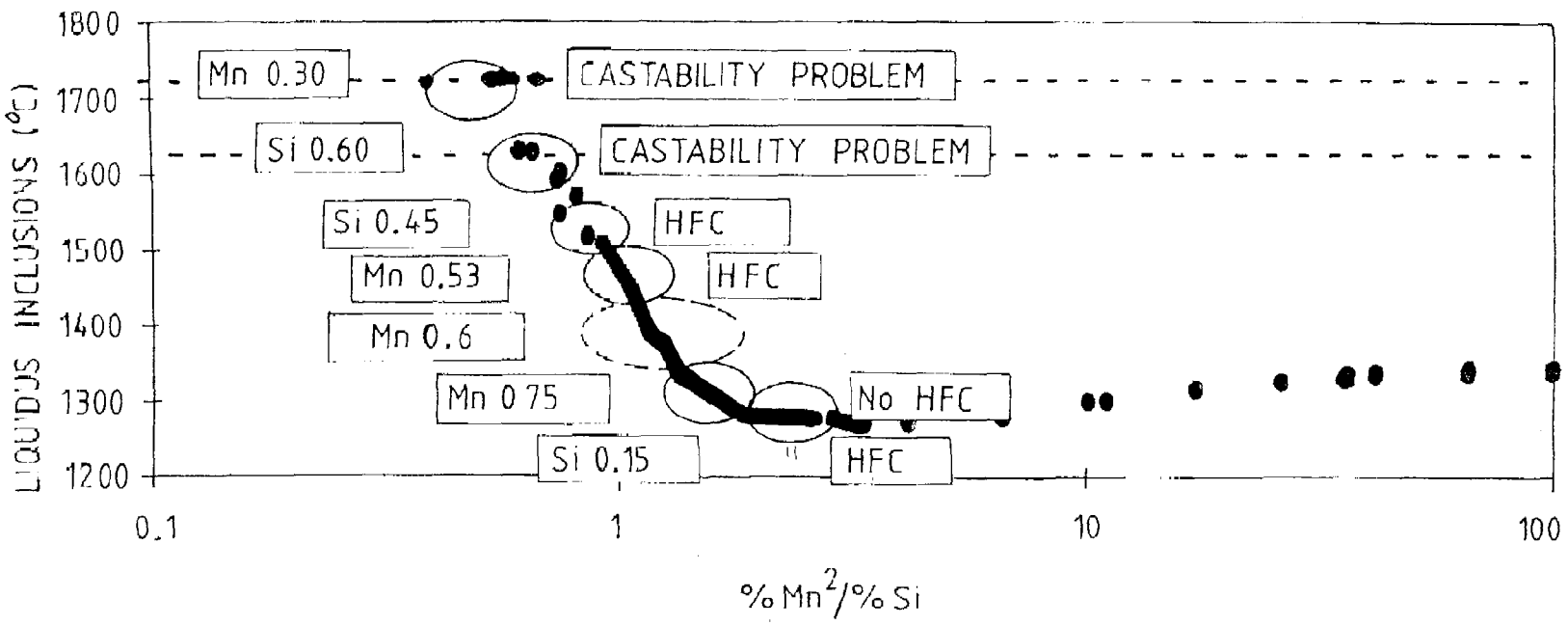
FIG. 7 shows the results of trial casts using steels of varying compositions.
Figure 8:
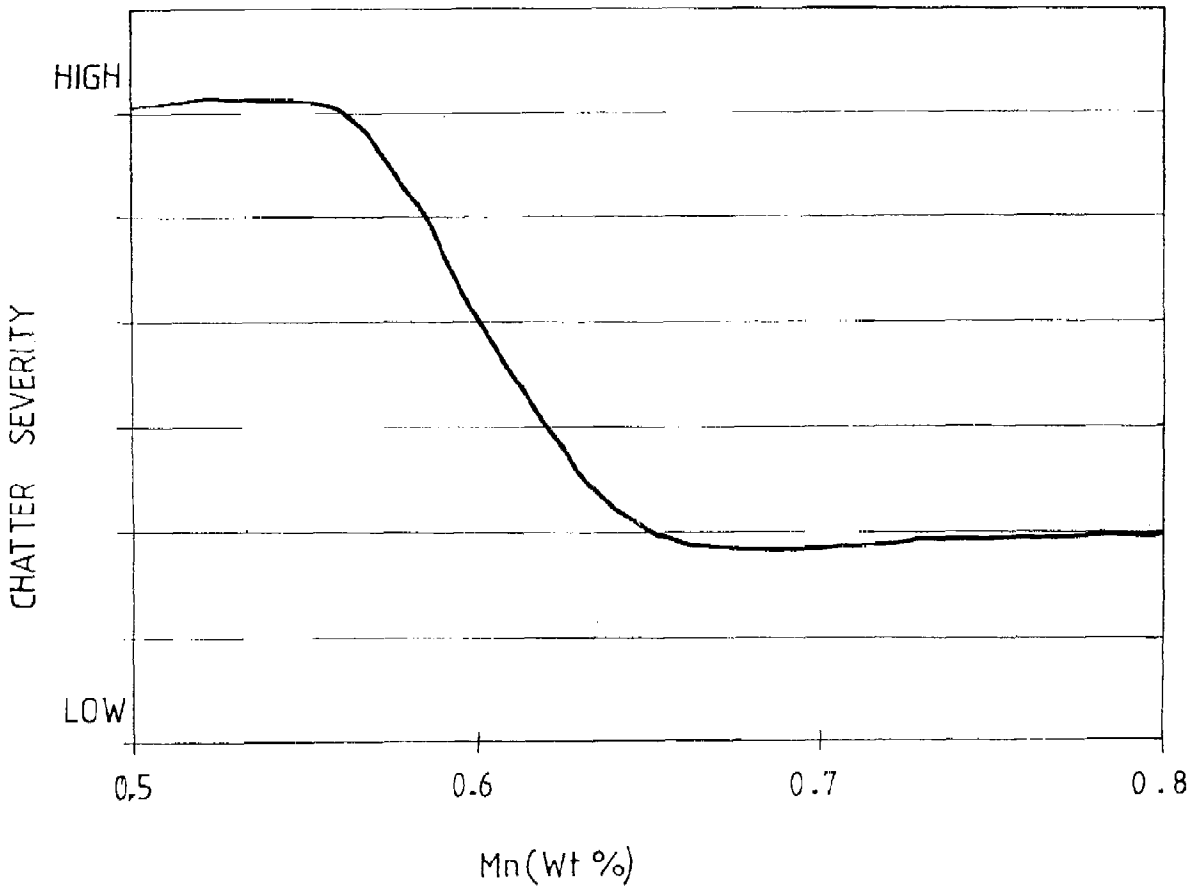
FIG. 8 shows the effect of manganese content on the generation of high-speed chatter defects.

FIG. 7 illustrates results of trials which demonstrate the effect of variation of inclusion liquidus temperatures due to varying manganese and silicon contents and FIG. 8 shows the effect of varying manganese content on chatter severity. In these trials the carbon content was maintained below 0.07% by weight. The trials show that the variation of the manganese content is the predominant factor in controlling high frequency chatter defects. Varying the silicon content does not have the same effect, but it is necessary for the silicon content to be maintained within the range 0.1 to 0.35% by weight. If the silicon content is too high, castability problems are encountered because the strip becomes fragile and there are solid inclusions. If the silicon content is too low, the volume of oxides is increased.

It will be seen from FIG. 8 that the manganese should be at least 0.6% to avoid the generation of chatter defects. However, it is now contemplated that manganese content above 0.55% will be sufficient to avoid chatter defects. As the casting speed is increased the manganese content of the steel need also be increased to avoid high speed chatter. Generally, the manganese content will be in the range 0.55 to 0.9% for casting speeds in the range 75 to 150 meters per minute.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A casting roll for continuous casting of steel strip comprised of casting surfaces textured by a random distribution of discrete projections having an average surface distribution of between 5 and 200 peaks per $mm^2$ and an average height of at least 10 microns.

2. A casting roll as claimed in claim 1 where each casting surface is defined by a grit blasted substrate covered by a protective coating.

3. A casting roll as claimed in claim 2 where the protective coating is an electroplated metal coating.

4. A casting roll as claimed in claim 3 where the substrate is copper and the plated coating is of chromium.

5. A casting roll as claimed in claim 2 where the protective coating is an alloy of nickel, molybdenum and cobalt.

6. A casting roll as claimed in claim 2 where the protective coating is an alloy of nickel, chromium and molybdenum.

7. A casting roll as claimed in claim 1 where each casting surface is a grit blasted surface.

8. A casting roll as claimed in claim 7 where the grit blasted surface is formed of nickel.

9. A casting roll as claimed in claim 1 where each casting surface is defined by a coating deposited onto a substrate to produce the random distribution of discrete projections on that surface.

10. A casting roll as claimed in claim 9 where the coating is formed by chemical deposition.

11. A casting roll as claimed in claim 9 where the coating is formed by electro-deposition.

12. A casting roll as claimed in claim 9 where the coating is formed of a material which has a low affinity for oxidation products in molten steel such that molten steel has greater affinity for the coating material and wets the coating in preference to said oxidation products.

13. A casting roll as claimed in claim 1 where the random distribution of discrete projections comprises a random height distribution of discrete projections.

14. A casting roll as claimed in claim 1 where the discrete projections have flat areas at the peaks.

15. A casting roll as claimed in claim 14 where the discrete projection flat areas are between about 100 square microns and about 400 square microns.

* * * * *